United States Patent [19]

Smith

[11] Patent Number: 4,917,632

[45] Date of Patent: Apr. 17, 1990

[54] SEISMIC TAKEOUT CONNECTOR

[75] Inventor: J. David Smith, Richmond, Tex.

[73] Assignee: Shaw Industries Ltd., Rexdale, Canada

[21] Appl. No.: 351,787

[22] Filed: May 15, 1989

[51] Int. Cl.[4] ..... H01R 9/03

[52] U.S. Cl. ..... 439/624; 439/278; 439/281; 439/651

[58] Field of Search ..... 439/271–283, 439/284, 290, 587, 588, 589, 606, 750, 738, 624, 651

[56] References Cited

U.S. PATENT DOCUMENTS

| | | | |
|---|---|---|---|
| 3,688,244 | 8/1972 | Savoca et al. | 439/282 |
| 4,063,793 | 12/1977 | Judd | 439/588 |
| 4,445,741 | 5/1984 | Annoot | 439/290 |
| 4,565,417 | 1/1986 | Dussel et al. | 439/750 |

FOREIGN PATENT DOCUMENTS

| | | | |
|---|---|---|---|
| 215884 | 4/1956 | Australia | 439/587 |
| 1099357 | 4/1981 | Canada | 439/271 |
| 647952 | 10/1962 | Italy | 439/588 |

*Primary Examiner*—David Pirlot
*Attorney, Agent, or Firm*—Vaden, Eickenroht, Thompson & Boulware

[57] ABSTRACT

An electrical connector is disclosed having an elongated conductor housing of non-conducting material with two electrical connector conductors embedded in and extending lengthwise of the housing. Each connector conductor has a socket at one end and a pin at the other. A sleeve of elastic material positioned on the housing so that a portion of the housing extends beyond the sleeve to serve as a male plug and a portion of the sleeve extends beyond the other end of the housing to combine with the housing to form a female plug. The sleeve has an integral elongated boot in the side through which a geophone cable extends. The conductors of the geophone cable are connected to the conductors embedded in the housing of the connector.

12 Claims, 3 Drawing Sheets

FIG. 1
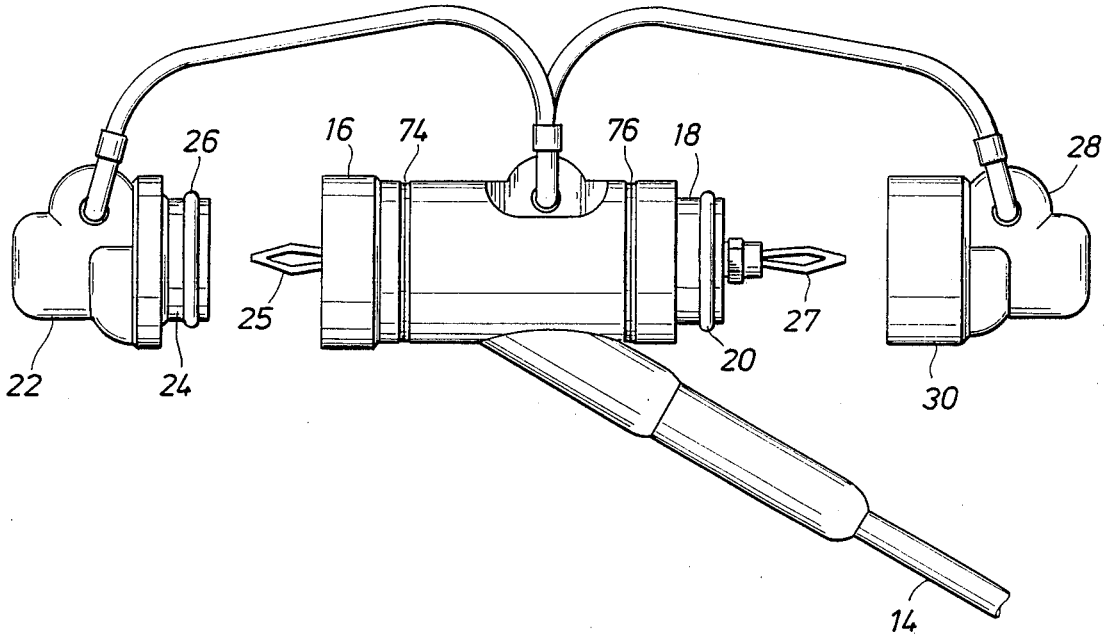
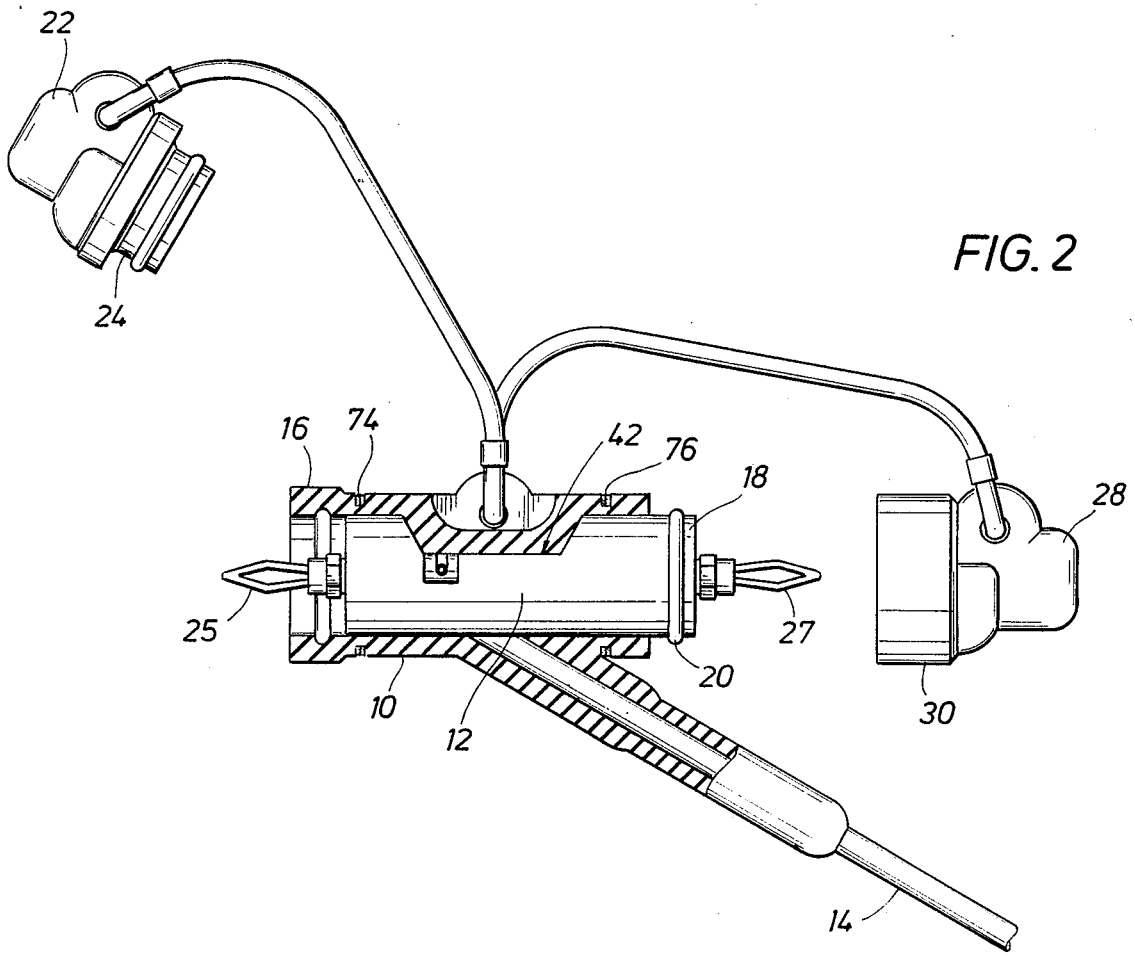
FIG. 2

SEISMIC TAKEOUT CONNECTOR

This invention relates to electrical connectors generally and in particular to a connector of the type shown and described in U.S. Pat. No. 3,646,499, which issued Feb. 29, 1972 to Don L. DeLano et al and is entitled "Multiple Connector" and in U.S. Pat. No. 4,445,741, which issued May 1, 1984 to Ira R. Annoot and is entitled "Double-Plug Seismic Connector".

Both the connector of the DeLano et al '499 patent and the connector of the Annoot '741 patent have elongated unitary bodies made of elastic insulating material. Each body has one end formed into a male connector plug and the other end formed into a female connector plug. Embedded in each body are two laterally-spaced longitudinally extending electrical conductors. Delano et al have a third longitudinal conductor that is used as a ground connection and is optional. Each conductor has a socket at one end and a pin at the other that serve as the electrical contacts of the male and female electrical plugs at opposite ends of the body.

The Delano et al '499 connector has three insulated conductor cables entering the body from the side. The conductor of one of the cables is electrically connected and anchored to one of the longitudinally extending conductors. The conductor of one of the other cables is electrically connected and anchored to one of the other longitudinally extending conductors. The conductor of the third cable is electrically connected and anchored to the third longitudinally extending conductor to provide a ground connection. The third cable and conductor are optional. The Annoot connector has a two conductor cable extending out the side of the body. One of the conductors is electrically connected and anchored to one of the longitudinally extending conductors and the other is electrically connected and anchored to the other longitudinally extending conductors. In both connectors the longitudinally extending conductors, the anchors, and portions of the cables coming in from the side are embedded in the body of the connector when it is molded.

Another connector that is the functional, but not the structural, equivalent of the DeLano et al and the Annoot patents is described in U.S. Pat. No. 4,477,136, which issued Oct. 16, 1984 to J. David Smith and is entitled "Takeout Connector". This connector has a flat-sided body that is generally rectangular in cross-section. Male and female electrical plugs are positioned side-by-side on one end of the connector body. The electrical plugs are formed as an integral part of the unitary molded body of elastic insulating material. Extending out the other end of the body is a two conductor cable, the conductors of which are electrically connected to the electrical contacts of the male and female electrical plugs.

The main object of the '741 and the '136 connectors was to provide a connector for electrically connecting a plurality of strings of geophones to a single takeout connector on the spread cable. The DeLong et al connector can be used for the same purpose.

All of these connectors have a common problem. They all use a molded unitary body of elastic material in which the components and the electrical connections are embedded. This makes them difficult to repair. In fact, to repair one of these connectors, the components have to be separated from the body, the repairs made, and a new body molded around the components. The value of the salvaged components would probably not justify such a procedure.

It is an object of this invention to provide such a connector that has all of the advantages of the '499, the '741, and the '136 connectors and, in addition, can be repaired in the field.

It is another object of this invention to provide such a connector having a housing for the connector conductors that is made of relatively rigid, non-elastic, non-conducting material that holds the conductors in spaced parallel relationship and provides a male plug at one end and a replaceable outer sleeve of elastomeric material that covers most of the housing and provides a female plug adjacent the opposite end of the conductor housing.

It is another object of this invention to provide such a connector having an elongated housing of relatively rigid non-conducting material with parallel conductors extending longitudinally of the housing and embedded therein, one end of each conductor having a socket for receiving a pin and the other end of each conductor having a pin attached thereto, a sleeve of elastomeric material stretched over and covering all but one end portion of the housing for that end portion of the housing to serve as a male plug for physically connecting the housing to the female plug of another connector, said sleeve extending beyond the other end of the housing to form a female plug to receive the male plug of another connector, a cable extending through the side wall of the sleeve, and means for electrically connecting each of the conductors in the cable to one of the conductors embedded in the housing of the connector.

These and other objects, advantages, and features of this invention will be apparent to those skilled in the art from a consideration of this specification including the attached drawings and appended claims.

IN THE DRAWINGS

FIG. 1 is a side view, in elevation, of the connector of this invention with the dust caps disconnected;

FIG. 2 is a side view of the connector of FIG. 1 with the sleeve of elastic material shown in cross-section;

Figure 4:
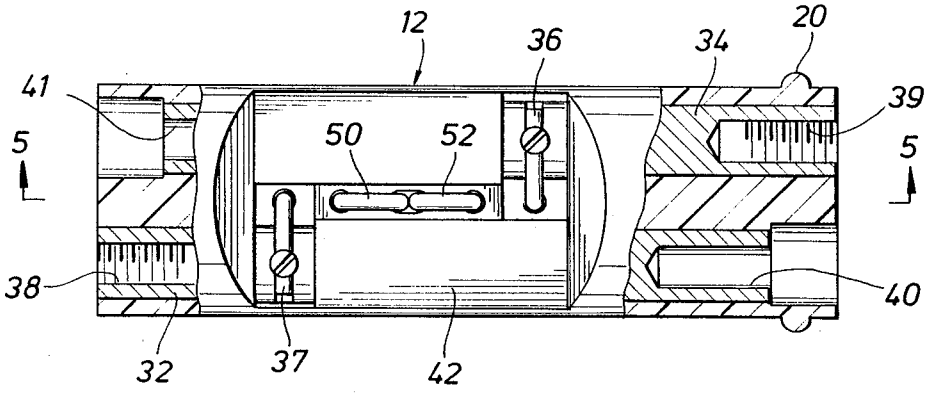
FIG. 4 is a view of the conductor housing looking in the direction of the arrows 4—4 in FIG. 3 with a portion of the housing broken away to show the ends of one of the two conductors embedded in the housing.

The main parts of this connector are outer sleeve 10, inner conductor housing 12, and geophone leader cable 14. When assembled, they look like the connector in FIG. 1. The tubular sleeve is positioned on the cylindrical housing so that one end extends beyond the housing to provide a female plug and the other end is spaced from the end of the housing to allow the uncovered end portion of the housing to serve as a male plug. The female plug is indicated by the number 16 and the male plug by the number 18. The sleeve is made of a stretchable material, such as an elastomer. The sleeve or boot has an inside diameter smaller than the housing so that it is stretched when pulled over the housing to form a watertight seal. The elastic material of the sleeve forming female plug 16 will also stretch and allow a solid male plug, such as plug 18, of another connector to be inserted in the cylindrical portion of the female plug to also form a watertight seal. The stretched elastomeric material will engage semi-circular ring 20 on the male plug to form a secondary watertight seal between the male plug and the female plug and to help hold the two in engagement. Dust cap 22 includes a portion 24 shaped like male plug 18 for inserting in female plug 16 to close the end of the sleeve and protect male electrical contact 25. Dust cap 28 is provided with a resilient cylindrical portion 30 that is dimensioned the same as female plug 16 to fit over male plug 18 on the other end of the connector and protect electrical contact 27.

Conductor housing 12 is molded of a rigid, non-conducting material, such as a polycarbonate, and has embedded in it, when molded, two laterally spaced, longitudinally extending electrical conductors 32 and 34, as shown in FIG. 4. Each conductor is formed from a solid bar of conductive material, such as copper. Each conductor has transverse slots 36 and 37 where the ends of the conductors in the geophone cable will be electrically connected to the conductor. One end of each conductor has been tapped to provide threaded holes 38 and 39. The other ends have been drilled to provide socket 40 and 41 for receiving the male electrical contact of another connector.

Figure 3:
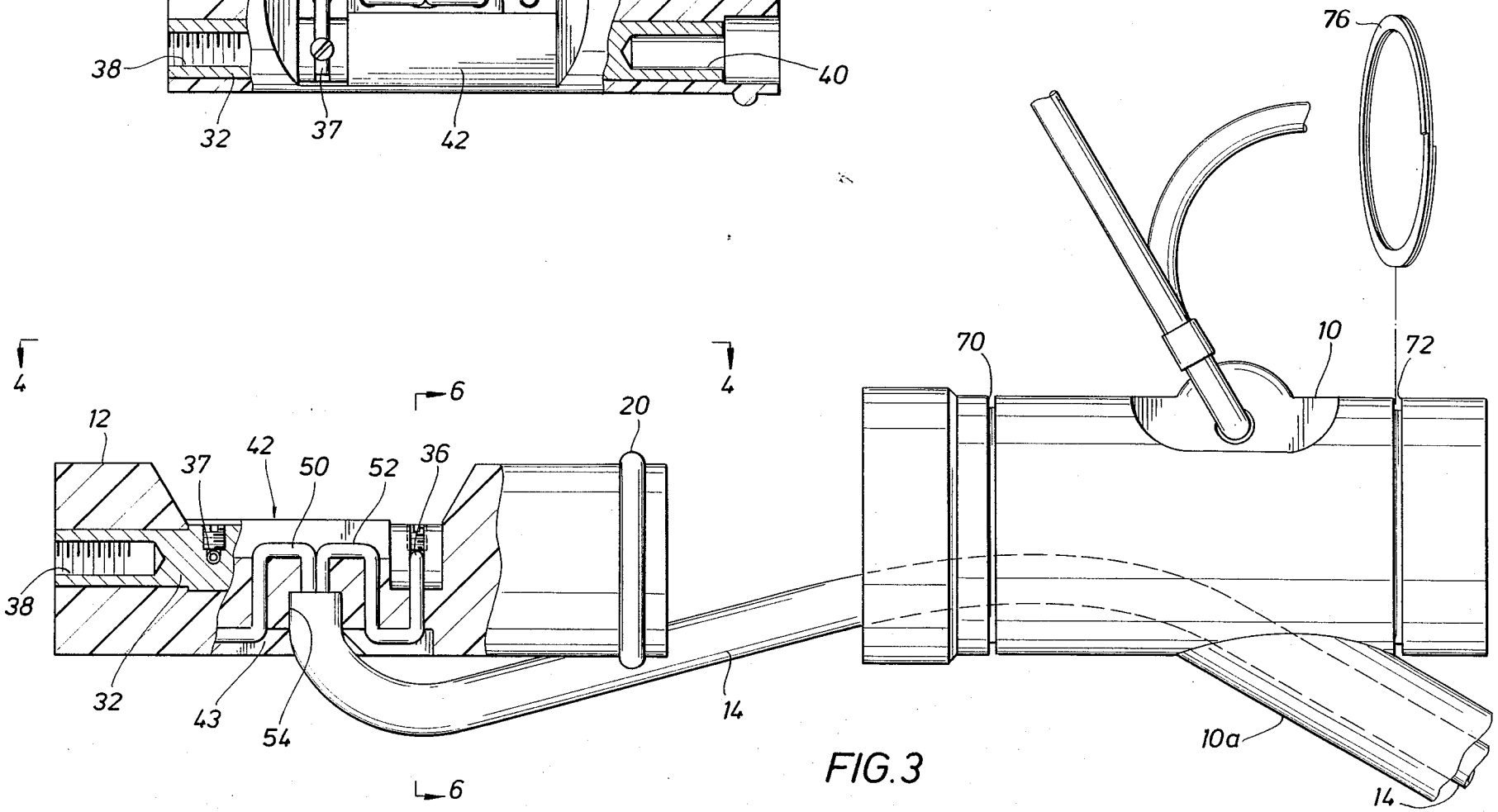
FIG. 3 is a side view of the connector before the sleeve has been moved into position over the conductor housing with the conductor housing shown partially in section.
Figure 5:
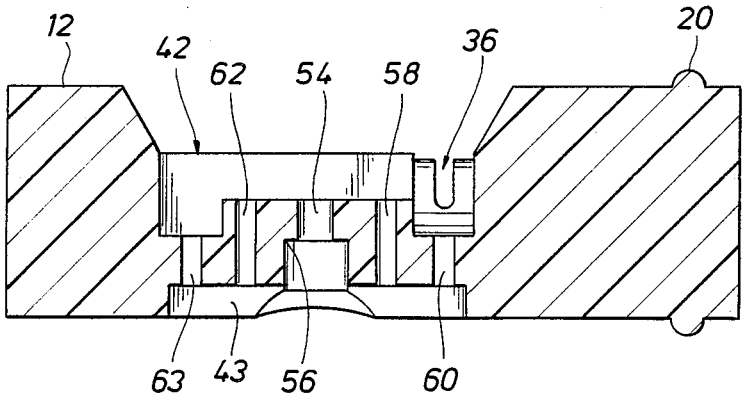
FIG. 5 is a sectional view of the housing taken along line 5—5 of FIG. 4.
Figure 6:
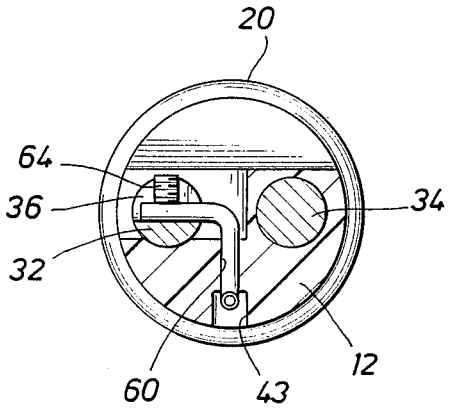
FIG. 6 is a sectional view taken along line 6—6 of FIG. 3.

The conductor housing has notch 42 on its top side that exposes grooves 36 and 37 in the conductors that are embedded in the housing. Extending longitudinally of the body, as shown in FIG. 5, are a plurality of openings through which the conductors of the leader cable are threaded before being electrically connected to one of the conductors. The openings extend between notch 42 and longitudinal slot 43. As shown in FIG. 3, the outer jacket of insulation is removed from the end of cable 14 exposing insulated conductors 50 and 52. They are brought from the bottom of the housing upwardly through opening 54 until the end of the outer jacket engages shoulder 56 formed by the lower larger diameter portion of opening 54. The conductors are then separated and one is threaded through openings 58 and 60 where the end of the conductor can be brought through slot 36 of conductor 32. The other cable conductor 50, in turn, is threaded through openings 62 and 63 until it is in a position to be extended across the bottom of slot 37. Metallic screws, such as screw 64 shown in FIG. 6 that have a larger diameter than the width of the slot so that they engage both sides of the slot are screwed downwardly into engagement with the conductor. The end of the screw is pointed so that it penetrates the insulation on the conductor and extends on through the conductor into solid engagement with the longitudinal conductor in the housing so that a good electrical contact is made between the screw, the geophone cable conductor, and the longitudinally extending conductors in the connector. Before the geophone cable conductors are connected to the conductors in the housing, the geophone cable is threaded through tubular boot 10*a*, which is an integral part of the unified molded body of elastic material forming the sleeve.

Now the parts will be as shown in FIG. 3 ready for sleeve 10 to be stretched over conductor housing 12. The stretched sleeve will fit snugly on the housing so a lubricant should be provided to assist the movement of the sleeve into the position shown in FIG. 2. The sleeve is internally configured so that a portion of it will move into notch 42 in the conductor housing and thereby secure the sleeve against inadvertent longitudinal movement relative to the housing.

To make sure that the sleeve is held in sealing engagement with the outer surface of the conductor housing, annular slots 70 and 72 are formed in the outer surface of the sleeve adjacent opposite ends of the sleeve. When the sleeve has been positioned on the housing, spiral coil springs 74 and 76 are positioned in the annular slots and exert a compressive force on the portion of the sleeve between the springs and the housing to hold the sleeve in sealing engagement with the housing. After the sleeve has been positioned over the housing, male electrical contacts or banana plugs are screwed into the threaded ends of the conductors embedded in the housing and the assembly is complete.

With the construction of this connector, should the electrical connection between one of the conductors of the geophone cable and one of the conductors in the connector be broken for some reason, the connector can be repaired simply by removing the sleeve from the conductor housing. This will expose the faulty connection, which can be corrected. The sleeve is then stretched back over the conductor housing and the connector is ready to go back into service. Before the sleeve is removed, of course, the coil springs will have to be removed and then replaced when the connector is reassembled. Probably, the practice will be to cut the sleeve off the housing and replace it with a new sleeve each time the connector is repaired. This should be done in all cases when the connector has been in service for a long time.

From the foregoing it will be seen that this invention is one well adapted to attain all of the ends and objects hereinabove set forth, together with other advantages which are obvious and which are inherent to the apparatus and structure.

It will be understood that certain features and subcombinations are of utility and may be employed without reference to other features and subcombinations. This is contemplated by and is within the scope of the claims.

Because many possible embodiments may be made of the invention without departing from the scope thereof, it is to be understood that all matter herein set forth or shown in the accompanying drawings is to be interpreted as illustrative and not in a limiting sense.

What is claimed is:

1. An electrical connector comprising an elongated housing of non-conducting material, two electrical connector conductors extending lengthwise of the housing, each connector conductor having a socket at one end and a pin at the other, a sleeve of elastic material positioned on the housing so that a portion of the housing extends beyond the sleeve to serve as a male plug and a portion of the sleeve extends beyond the other end of the housing to combine with the housing to form a female plug, said sleeve having an elongated leader cable entry boot in its side surface for forming a watertight seal with a geophone cable, a geophone cable extending through the cable entry boot, and means connecting the conductors in the geophone cable to the connector conductors extending lengthwise of the housing.

2. The electrical connector of claim 1 in which the housing is provided with a transverse notch and the boot has an internal portion that extends into the notch and holds the housing from moving relative to the boot.

3. The electrical connector of claim 2 in which the notch exposes a short section of each connector conductor and in which the housing has a plurality of openings extending through the housing from the notch through which a pair of conductors from a geophone cable can be wound before being electrically connected to the exposed sections of the connector conductors.

4. The connector of claim 1 further provided with means for clamping the sleeve to the housing on opposite sides of the leader cable entry to prevent water from traveling between the housing and the sleeve and contacting the connector conductors.

5. The connector of claim 4 in which the clamping means includes annular grooves in the sleeve on opposite sides of the geophone cable entry and spring means located in the grooves clamping the sleeve to the housing.

6. The connector of claims 1, 2 or 3 in which the elastic material of the sleeve is stretched when positioned on the body.

7. The connector of claims 1 or 3 in which the electrical connector conductors are embedded in the conductor housing.

8. An electrical connector comprising an elongated housing of non-conducting material, two electrical connector conductors embedded in and extending lengthwise of the housing, each connector conductor having a socket at one end and a pin at the other, a sleeve of elastic material stretched on the housing in position for a portion of the housing to extend beyond the sleeve to serve as a male plug and for a portion of the sleeve to extend beyond the other end of the housing to combine with the housing to form a female plug, said sleeve having an integral elongated geophone cable entry boot in its side surface for forming a watertight seal with a geophone leader cable extending through the boot into the sleeve, a geophone leader cable extending through the boot, and means connecting the conductors in the geophone leader cable to the connector conductors embedded in the housing.

9. The electrical connector of claim 8 in which the housing is provided with a transverse notch and the boot has an internal portion that extends into the notch and holds the housing from moving relative to the boot.

10. The electrical connector of claim 9 in which the notch exposes a short section of each connector conductor and in which the housing has a plurality of openings extending through the housing from the notch through which a pair of conductors from a geophone cable can be wound before being electrically connected to the exposed sections of the connector conductors.

11. The connector of claim 8 further provided with means for clamping the sleeve to the housing on opposite sides of the leader cable entry to prevent water from traveling between the housing and the sleeve and contacting the connector conductors.

12. The connector of claim 11 in which the clamping means includes annular grooves in the sleeve on opposite sides of the leader cable entry and spring means located in the grooves clamping the sleeve to the housing.

* * * * *